US010123928B2

(12) United States Patent
Leismer et al.

(10) Patent No.: US 10,123,928 B2
(45) Date of Patent: Nov. 13, 2018

(54) MUSCULOSKELETAL VIBRATION SYSTEM PROVIDING INDEPENDENT VIBRATION AND BIAS CONTROL

(71) Applicant: WISYS Technology Foundation, Inc., Madison, WI (US)

(72) Inventors: Jeffrey M. Leismer, Sheboygan, WI (US); Nadder D. Sahar, Milwaukee, WI (US)

(73) Assignee: WISYS TECHNOLOGY FOUNDATION, INC., Madison, WI (US)

( * ) Notice: Subject to any disclaimer, the term of this patent is extended or adjusted under 35 U.S.C. 154(b) by 1035 days.

(21) Appl. No.: 14/208,477

(22) Filed: Mar. 13, 2014

(65) Prior Publication Data

US 2014/0276273 A1 Sep. 18, 2014

Related U.S. Application Data

(60) Provisional application No. 61/788,904, filed on Mar. 15, 2013.

(51) Int. Cl.
*A61H 1/02* (2006.01)
*A63B 69/00* (2006.01)
(Continued)

(52) U.S. Cl.
CPC ..... *A61H 1/0255* (2013.01); *A61H 23/0218* (2013.01); *A63B 21/0058* (2013.01);
(Continued)

(58) Field of Classification Search
CPC ..... A61H 2201/12; A61H 2201/1436; A61H 2201/1481; A61H 2201/149; A61H 1/003; A61H 1/005; A61H 1/006; A61H 1/008; A61H 11/00; A61H 2201/16; A61H 2201/123; A61H 1/0244; A61H 23/02; A61H 23/0218; A61H 23/0236;
(Continued)

(56) References Cited

U.S. PATENT DOCUMENTS 2,715,901 A 8/1955 Blake
2,845,063 A 7/1958 Allen
(Continued)

FOREIGN PATENT DOCUMENTS

EP 2160168 3/2010
EP 2174693 4/2010
(Continued)

OTHER PUBLICATIONS

Extended European Search Report dated Aug. 16, 2016; EP App. No. 14768406.2-1658/2969060 (Regional Phase of PCT/US2014026652); 8 pages.
(Continued)

*Primary Examiner* — Michael Tsai
(74) *Attorney, Agent, or Firm* — Boyle Fredrickson, S.C.

(57) ABSTRACT

An apparatus for musculoskeletal stimulation allows independent electronic control of vibration parameters and overall biasing force so that an optimum combination of these parameters may be obtained regardless of the user's weight and without the need for adjustment of mechanical weights or springs.

17 Claims, 5 Drawing Sheets

(51) Int. Cl.

| | |
|---|---|
| ***A61H 23/02*** | (2006.01) |
| ***A63B 21/005*** | (2006.01) |
| ***A63B 23/035*** | (2006.01) |
| ***A63B 23/04*** | (2006.01) |
| ***A63B 24/00*** | (2006.01) |
| ***A63B 21/00*** | (2006.01) |
| *A63B 71/00* | (2006.01) |

(52) U.S. Cl.

CPC .. *A63B 21/00178* (2013.01); *A63B 21/00196* (2013.01); *A63B 21/4045* (2015.10); *A63B 23/03525* (2013.01); *A63B 23/0405* (2013.01); *A63B 24/0087* (2013.01); *A63B 69/0057* (2013.01); *A61H 2201/0176* (2013.01); *A61H 2201/1215* (2013.01); *A61H 2201/164* (2013.01); *A61H 2201/5007* (2013.01); *A61H 2201/5046* (2013.01); *A61H 2201/5064* (2013.01); *A61H 2201/5084* (2013.01); *A61H 2203/0437* (2013.01); *A63B 21/4034* (2015.10); *A63B 2024/0093* (2013.01); *A63B 2071/0081* (2013.01); *A63B 2208/0238* (2013.01); *A63B 2220/10* (2013.01); *A63B 2220/30* (2013.01); *A63B 2220/40* (2013.01); *A63B 2220/805* (2013.01)

(58) Field of Classification Search

CPC ..... A61H 23/0245; A61H 23/0254; A61H 23/0263; A61H 23/04; A61H 2205/10; A61H 2205/106

See application file for complete search history.

(56) References Cited

U.S. PATENT DOCUMENTS

| | | | | |
|---|---|---|---|---|
| 3,550,585 | A * | 12/1970 | Howard | A61H 1/006 601/35 |
| 4,858,598 | A * | 8/1989 | Halpern | A61H 1/005 482/96 |
| 5,273,028 | A * | 12/1993 | McLeod | A61F 2/28 601/35 |
| 6,105,252 | A | 8/2000 | Andis | |
| 6,620,117 | B1 | 9/2003 | Stephan et al. | |
| 6,923,773 | B2 | 8/2005 | Gunnar et al. | |
| 7,662,115 | B2 | 2/2010 | Leismer | |
| 9,283,134 | B2 | 3/2016 | Leismer et al. | |
| 2003/0199795 | A1 | 10/2003 | Leismer | |
| 2004/0067833 | A1* | 4/2004 | Talish | A61H 1/001 482/148 |
| 2005/0033203 | A1 | 2/2005 | Son | |
| 2006/0217639 | A1 | 9/2006 | Leismer | |
| 2008/0132813 | A1 | 6/2008 | Katsuta | |
| 2008/0167589 | A1 | 7/2008 | Fung | |
| 2009/0086569 | A1 | 4/2009 | Wu et al. | |
| 2009/0281466 | A1 | 11/2009 | Corix et al. | |
| 2010/0222722 | A1 | 9/2010 | Leismer | |
| 2010/0312154 | A1* | 12/2010 | Becker | A61H 1/005 601/49 |
| 2012/0209156 | A1 | 8/2012 | Leismer et al. | |
| 2014/0052030 | A1* | 2/2014 | Shields | A61H 1/006 601/15 |

FOREIGN PATENT DOCUMENTS

| | | |
|---|---|---|
| EP | 2160168 | 12/2011 |
| JP | 2001346846 | 12/2001 |
| JP | 5972929 | 8/2016 |
| WO | WO200145564 | 6/2001 |
| WO | 2006030298 | 3/2006 |
| WO | WO2006061834 | 6/2006 |
| WO | WO2007066726 | 6/2007 |
| WO | 2012112711 | 8/2012 |
| WO | WO2013074137 | 5/2013 |

OTHER PUBLICATIONS

Office Action Dated Oct. 21, 2016 from State intellectual Property Office of the P.R.C.; 18 pages.

International Search Report for International application No. PCT/US2014/025652.

Merriman et al., The Effects of Whole-Body Vibration Training in Aging Adults: A Systematic Review, Journal of Geriatric Physical Therapy, vol. 32:3:09.

Slatkovska et al., Effect of whole-body vibration on BMD: a systematic review and meta-analysis, published online Apr. 21, 2010, Osteoporos Int, DOI 10.1007/s00198-010-1228-z.

Stengel et al., Effect of whole-body vibration on neuromuscular performance and body composition for females 65 years and older: a randomized-controlled trial: Feb. 5, 2010, Scandinavian Journal of Medicine & Science in Sports, doi: 10.1111/j.1600-0838.2010.01126.x.

Machado et al., Whole-body vibration training increases muscle strength and mass in older women: a randomized-controlled trial, Dec. 29, 2008, Scandinavian Journal of Medicine & Science in Sports, doi: 10.1111/j.1600-0838.2009.00919.x.

Mulder et al., Influence of vibration resistance training on knee extensor and plantar flexor size, strength, and contractile speed characteristics after 60 days of bed rest, Oct. 1, 2009, Journal of Applied Physiology, 107:1789-1798, 2009, doi: 10.1152/japplphysiol.00230.2009.

International Search Report for International application No. PCT/US2012/025296, dated Feb. 15, 2012.

International Search Report for International application No. PCT/US2012/025294, dated Feb. 15, 2012.

Extended European Search Report; dated Apr. 11, 2016; EP App. No. 1274721234/EP 2675419 (Regional Phase of PCT/US2012025296); 9 pages.

JP2014085958 Office Action; dated Mar. 22, 2016; 2 pages.

JP2014055958 Office; dated Dec. 8, 2015; 3 pages.

EP12747212 Invitation to Correct; Dec. 5, 2017; 6 pages.

EP12747212 Office Action; dated May 18, 2017; 3 pages.

CN201480027799; Office Action; dated Jun. 12, 2017; 18 pages.

JP2016501931 Office Action; Feb. 6, 2018; 6 pages.

CA2854259 Office Action; dated Feb. 21, 2018; 3 pages.

* cited by examiner

MUSCULOSKELETAL VIBRATION SYSTEM PROVIDING INDEPENDENT VIBRATION AND BIAS CONTROL

CROSS REFERENCE TO RELATED APPLICATION

This application claims the benefit of U.S. provisional application 61/788,904 filed Mar. 15, 2013 and hereby incorporated by reference.

STATEMENT REGARDING FEDERALLY SPONSORED RESEARCH OR DEVELOPMENT

This invention was made with government support under AG037354 awarded by the National Institutes of Health. The government has certain rights in the invention

BACKGROUND OF THE INVENTION

The present invention provides a method and apparatus for applying a stimulating vibration to a person's arms or legs and in particular to an apparatus providing improved control of vibration and biasing force.

During periods of disuse (physical inactivity), the body "deconditions" at a rapid rate, a phenomenon known as disuse atrophy. In deconditioning, muscle fibers reduce in strength and size, muscles shorten and denervate, tendons and ligaments develop adhesions and permanently lose their flexibility resulting in loss of range of motion and bones may lose their strength. Such deconditioning can result in an increased fall injury risk and secondary complications such as obesity, cardiovascular disease, diabetes, and other life threatening ailments can arise.

Weight-bearing physical activity is the best known method for reducing or reversing disuse atrophy, but the underlying causes of disuse atrophy often limit one's ability to perform the necessary exercises.

Harness-based treadmills and aquatic therapy pools are capable of enabling persons with reduced mobility to perform physical activity under partial bodyweight loading. However, these modalities are costly to acquire, require significant space in a rehabilitation facility, are difficult to operate and may also be impractical for weakened individuals.

Electrical stimulation is an alternative means of inducing muscle activation in users who are unable to perform physical activity on their own. However, electrical muscle stimulation is site-specific, meaning it affects tissue(s) only in the vicinity of the electrode supplying electricity to the muscle, and it can cause discomfort and pain if used as a sole means to maintain muscle strength in the absence of physical activity.

An alternative to the above techniques is vibration therapy. Typical vibration therapy provides whole body vibration with the user standing on a vibrating platform. This also can be impractical for users with limited mobility. U.S. Pat. No. 7,662,115 and US patent application 2012/0209156 describe vibration therapy systems that may be applied to user limbs, such as the legs, with a recumbent or supine individual.

SUMMARY OF THE INVENTION

The present invention provides an improved system for applying vibration therapy to user limbs that allows isolated separate electronic control of vibration and biasing force applied to the limb. The invention permits a variety of therapy profiles to be implemented including those which vary bias force, vibration, and/or limb position in an exercise routine.

In one embodiment, the invention provides an apparatus having an operator surface adapted to communicate with a distal portion of a user's limb to communicate forces thereto. A bias system communicates with the operator surface to receive a first electrical signal controlling a bias position of the limb and a vibration system communicates with the operator surface to receive a second electrical signal independent of the first electrical signal controlling a vibration applied to the limb. A control circuit provides the first and second electrical signals according to operator input commands.

It is thus a feature of at least one embodiment of the invention to permit independent control of vibration and bias force to allow each to be optimized separately.

The first electrical signal may provide an indication of desired force between the operator surface and the limb and the bias system may use feedback control of the force between the operator surface and the limb by receiving the first electrical signal and adjusting motion of the operator surface according to a difference between the first electrical signal and a signal indicating a force between the operator surface and the limb.

It is thus a feature of at least one embodiment of the invention to provide electronically controllable bias force that can be maintained, for example, over different levels of vibration and different positions of the operator surface for more consistent treatment.

The controller may receive a third electrical signal providing an indication of desired position of the operator surface and may output an indication of a difference between the third electrical signal and a signal indicating a position of the operator surface.

It is thus a feature of at least one embodiment of the invention to provide for dynamic motion during vibration therapy by guiding a user with respect to limb movement independent of the vibration and the bias force.

The vibration system may provide feedback control of a vibration of the operator surface by receiving the second electrical signal and adjusting vibration of the operator surface according to a difference between the first electrical signal and a signal related to a position of the operator surface.

It is thus a feature of at least one embodiment of the invention to provide electrically-controllable vibration that may be held constant or varied as desired.

The apparatus may include a sensor providing the signal related to a position of the operator surface providing one of position, velocity, and acceleration of the operator surface.

It is thus a feature of at least one embodiment of the invention to permit control of vibration amplitude, force and other qualities.

The control circuit may provide stored data describing a schedule of the first and second electrical signals over time to regenerate the first and second electrical signals.

It is thus a feature of at least one embodiment of the invention to permit the apparatus to be used in predefined exercise routines in which bias force and vibration may be varied over time.

The control circuit may provide an output adapted to be received by a user of the apparatus providing an indication that a desired force is being applied by the user to the operator surface.

It is thus a feature of at least one embodiment of the invention to permit instructions to the user with respect to applying force when the apparatus is used in an active mode without limb constraint, for example, during dynamic motion exercises.

In one example, the output to the user may be initiation of vibration of the operator surface.

It is thus a feature of at least one embodiment of the invention to provide a subtle yet intuitive indication that the user is applying the appropriate level force to the platform in the active mode.

Alternatively the output may be a display providing a visual guidance as to the application of the desired force.

It is thus a feature of at least one embodiment of the invention to provide guidance to the user that can offer information about applying the correct amount of force and any force shortfall or excess.

The control circuit may provide an output to the user of the apparatus indicating desired position of the operator surface as moved by extension or retraction of the user's legs or arms.

It is thus a feature of at least one embodiment of the invention to permit dynamic motion exercises, for example, under constant bias force.

The apparatus may include a seat for receiving a user positioned so that the user's feet may rest upon the operator surface with a lower portion of the user's legs substantially normal to the operator surface when the user is seated on the seat.

It is thus a feature of at least one embodiment of the invention to provide an apparatus that may be used conveniently by users who can support themselves in a seated position.

The apparatus may further include a user joint restraint constraining motion of the user's limb against force exerted on the user's limb by the operator surface.

It is thus a feature of at least one embodiment of the invention to allow the apparatus to be used in the passive mode without requiring significant user strength or participation.

The joint restraint may be a knee restraint for restraining upward motion of the user's knees when the user is seated in the seat providing at least one padded bolster held on a swing arm pivoting downward to apply the padded bolster against the upper surface of the user's knees when the user is seated in the seat supported by the operator surface and limiting upward motion of the user's knees.

It is thus a feature of at least one embodiment of the invention to provide a simple joint restraint that does not unduly block entrance or exit from the seat when retracted.

These particular objects and advantages may apply to only some embodiments falling within the claims and thus do not define the scope of the invention.

DETAILED DESCRIPTION OF THE PREFERRED EMBODIMENT

Figure 1:
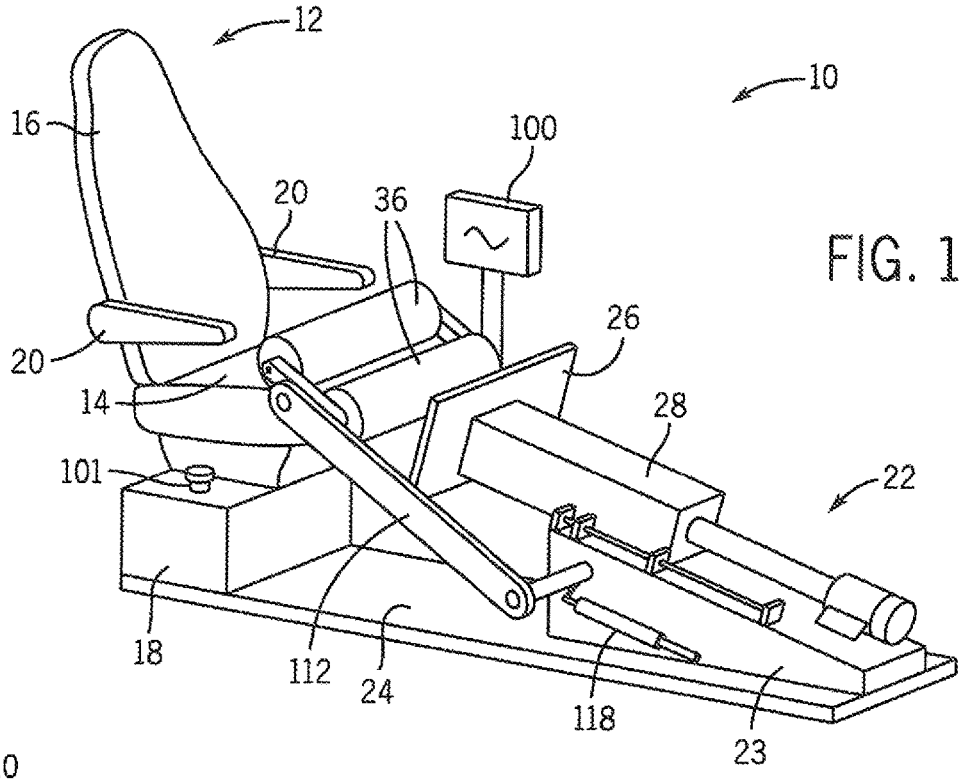
FIG. 1 is a perspective view of one embodiment of the present invention providing seated vibration therapy.
Figure 2:
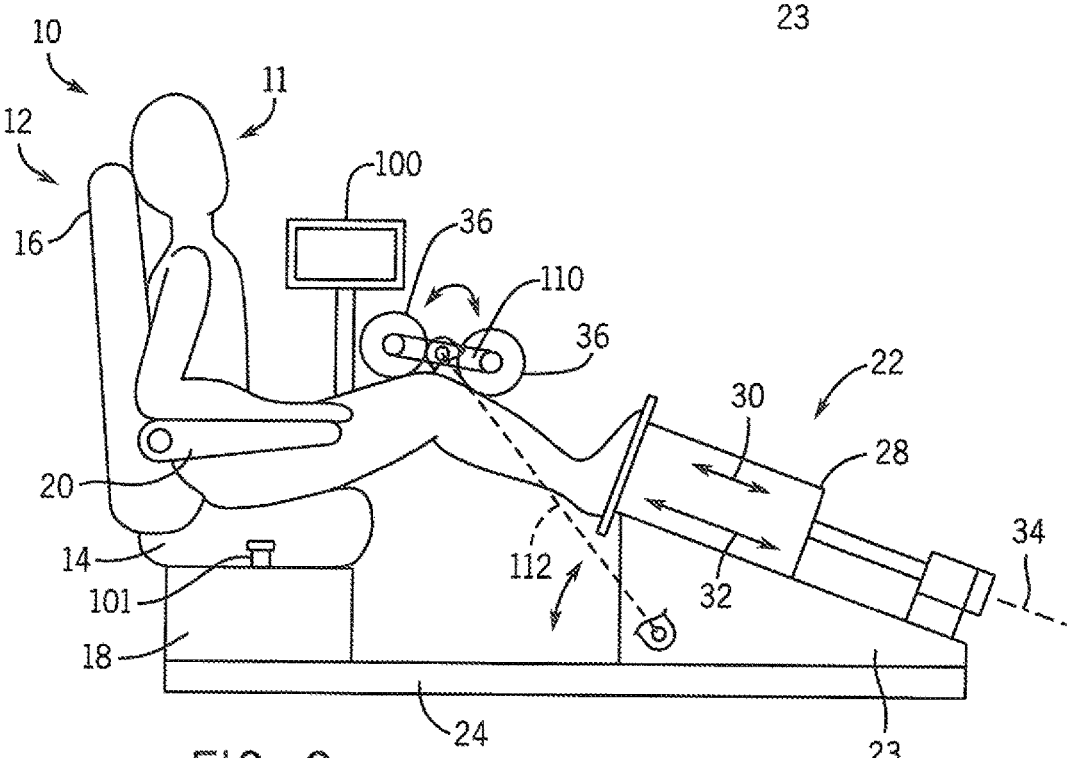
FIG. 2 is a simplified side elevational view of the embodiment of FIG. 1 showing motion of the various elements including a knee brace and a foot platform attached to an actuator assembly with respect to a user seated in the apparatus.

Referring now to FIGS. 1 and 2, a musculoskeletal stimulation device 10 may provide for a seat 12 presenting a substantially horizontal seating surface 14 and a back support 16 extending upward from a rear edge of the seating surface 14. The seat 12 maybe positioned on a pedestal 18.

The back support 16 may be adjustable in inclination (reclining) as is generally understood in the art and may provide left and right arm supports 20 extending horizontally forward so that a seated user 11 on the seat 12 may rest his or her forearms on the arm supports 20. The arm supports 20 may be pivotable upward against the sides of the back support 16 to facilitate ingress and egress from the seat 12. The seat 12 may swivel about a vertical axis to facilitate ingress and egress.

The pedestal 18 supports the seat 12 above the floor and may be fixed relative to a force unit 22 attached to a floor support 23 and positioned in front of the seat 12. Relative fixation between the seat 12 and the force unit 22 may be provided either by means of a connecting structure 24 communicating between the pedestal 18 and the floor support 23 or by connection of both the pedestal 18 and the floor support 23 directly to the floor which then provides for this mechanical communication. Alternatively, relative fixation between the seat 12 and the force unit 22 may be provided for by sufficiently high friction forces between the floor and floor support 23 as well as between the floor and the pedestal 18 that exceed the force generated or applied.

The force unit 22 supports a vibration surface 26 facing the seat 12, for example, a textured plate. The vibration surface 26 is positioned to receive the feet of the user 11 when the user 11 is positioned in the seat 12 with his or her feet slightly elevated with bent knees. In this respect, the top of the vibration surface 26 may slope away from the user 11 by about 30 degrees from vertical. Pressure by the feet and legs of the user 11 against the vibration surface 26 is resisted by the structure of the force unit 22 communicating through the connecting structure 24 or floor to the pedestal 18 and the back support 16.

The force unit 22 may hold an actuator assembly 28 communicating with the vibration surface 26 to impart a vibration motion 30 and/or a bias motion 32 to the vibration surface along an actuation axis 34 generally normal to the surface of the vibration surface 26 and aligned with the lower leg of the user 11. The floor support 23 may provide angulation to the force unit 22 to provide the desired angle of the actuation axis 34.

Generally, the vibration motion 30 and the bias motion 32 may be actively resisted by conscious muscular action of the user 11, as will be described below, in a dynamic mode or passively resisted by structure of the legs of the user 11 as braced against knee bolsters 36 limiting the bending of the knees of the user 11, in a passive mode, as will also be described below.

Figure 3:
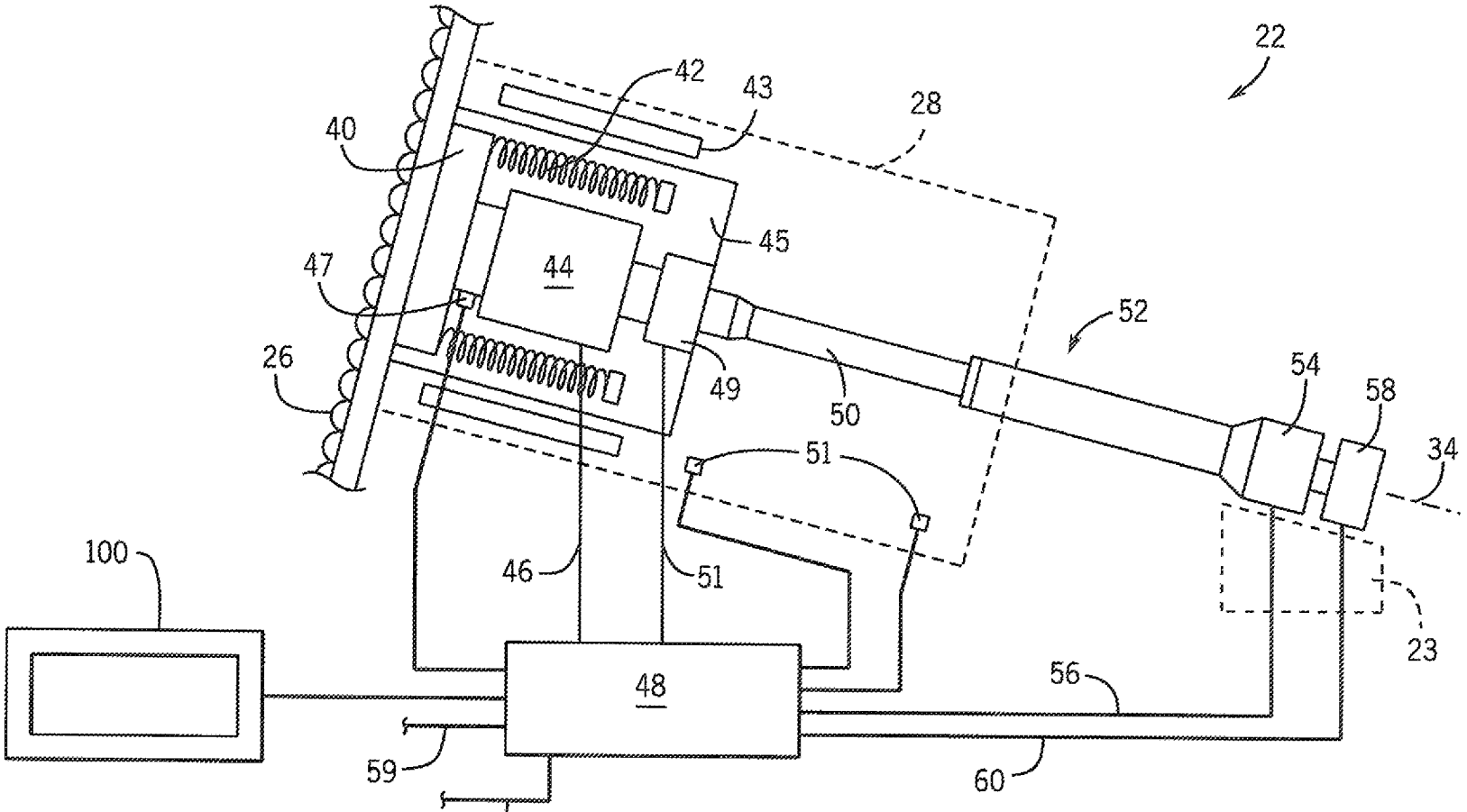
FIG. 3 is a block diagram of the actuator assembly showing the principal components that provide both separate vibration and coarse position control of the foot platform, the figure further showing a high-resolution optical position encoder, a force/position sensing load cell, limit switches, and rotary encoder.

Referring now to FIG. 3, a rear surface of the vibration surface 26 may attach to a mounting plate 40 within the force unit 22. The mounting plate 40 may be suspended, for example, at four corners on axially extending compression springs 42 allowing it to move in vibration along axis 34. The remaining ends of the axially extending compression springs 42 are fixed to a carriage 45 communicating through linear slides 43 with a stationary structure fixed relative to the floor support 23. The slides 43 provide for translation of the carriage 45 along axis 34 and may, for example, be recirculating linear ball bearings or other types well known in the art.

Also within the force unit 22, a voice coil 44 is centered between the compression springs 42 and attached at one end to the rear surface of the mounting plate 40. The voice coil 44 may produce short-excursion, high-force vibrations according to a vibration control signal 46 received from a controller 48 whose operation will be described below. In this application, the voice coil 44 may provide excursions of less than half an inch with forces in the range of 1 to >100 pounds at frequencies of from 10 to 100 hertz depending on the mass being driven. Voice coils of this type are commercially available from a variety of vendors and normally provide a tubular solenoid with multiple turns of conductor positioned about a magnet so that the current through the conductor generates an axial force in proportion to that current.

A high-resolution optical position sensor 47 may be attached to the carriage 45 to measure displacement of the vibration surface 26 along axis 34 with respect to the carriage 45 for precise characterization of short excursion vibrations of the vibration surface 26 as will be discussed. An output of the optical position sensor 46 may be provided to the controller 48.

The opposite end of the voice coil 44 is attached to a first end of a load cell 49 whose second end is attached to an actuator shaft 50 at a first end of a linear actuator 52. A second end of the linear actuator 52 is attached to the structure fixed with respect to the floor support 23.

As so positioned, the load cell 49 may measure an axial force exerted between the front of the vibration surface 26 and the structure of the floor support 23. The load cell 49 may provide for a force signal 51, reflecting this axial force, to the controller 48 as will be described below The linear actuator 52 may be attached at its end opposite the shaft 50 structure fixed against movement along axis 34 with respect to the floor support 23. Generally the linear actuator 52 may provide substantially greater translation of the vibration surface 26 than the voice coil 44 but at much lower operating speeds. For example, the linear actuator 52 may provide a range of extension of much more than one inch and typically on the order of 12 inches at a rate of less than one inch per second and typically less than three inches per second. Linear actuators of this type are commercially available from a variety of vendors and may provide, for example, a threaded shaft extending along axis 34 and engaging with a threaded collar, one of the two being rotatable by the stepper motor 54 to control extension of the actuator shaft 50 driven by movement of the threaded shaft through the threaded collar.

The stepper motor 54 may receive a stepper motor command signal 56 from the controller 48 that may be used to rotate the stepper motor by a given number of steps associated with a predetermined angular movement. The relative movement of the stepper motor 54 and hence the linear actuator 52 can therefore be easily determined by counting the steps of the stepper motor command signal 56. Absolute position of the stepper motor 54 and linear actuator 52 can be determined by "homing" the stepper motor 54 or actuator shaft 50 upon start up of the musculoskeletal stimulation device 10 by moving the vibration surface 26 to a known position against a limit switch or the like. Alternatively, or in addition, a rotary encoder 58 (absolute or incremental) may be attached to the stepper motor or a linear encoder may be attached between the linear actuator and floor support 23 to provide absolute position signal 60 to the controller 48.

The first and second limit switch 51 may be positioned to detect motion of the carriage 45 outside of the range established by the limit switches 51 representing a full travel range of the linear actuator 52. These limit switches 51 may also communicate with the controller 48 to prevent over travel of the carriage 45.

It will be appreciated that the vibration motion 30 and the bias motion 32 may be provided respectively by voice coil 44 and linear actuator 52. Generally the voice coil 44 can excite the vibration surface 26 at high rates, for example, to provide motion of the vibration surface 26 having a power spectrum concentrated at substantially greater than 10 hertz to provide vibratory excitation. In contrast, the linear actuator 52 may excite the vibration surface 26 to provide a pattern of motion having a power spectrum concentrated at substantially less than one hertz to provide a substantially steady-state force application.

The controller 48 may also communicate with a user interface 100, for example, providing a touchscreen for receiving commands from the user 11 and providing a display to the user 11. An emergency stop line 59 communicates between the controller 48 and an emergency stop button 101 (shown in FIG. 1 as will be described below). A clutch line 61 provides control to an electronic clutch 116 which will also be described below.

The controller 48 will generally provides one or more electronic computer processors communicating with electronic memory for storing a program to be executed by the electronic computer according to data and the program in the memory. The memory provides a non-transient storage medium for this program.

Figure 4:
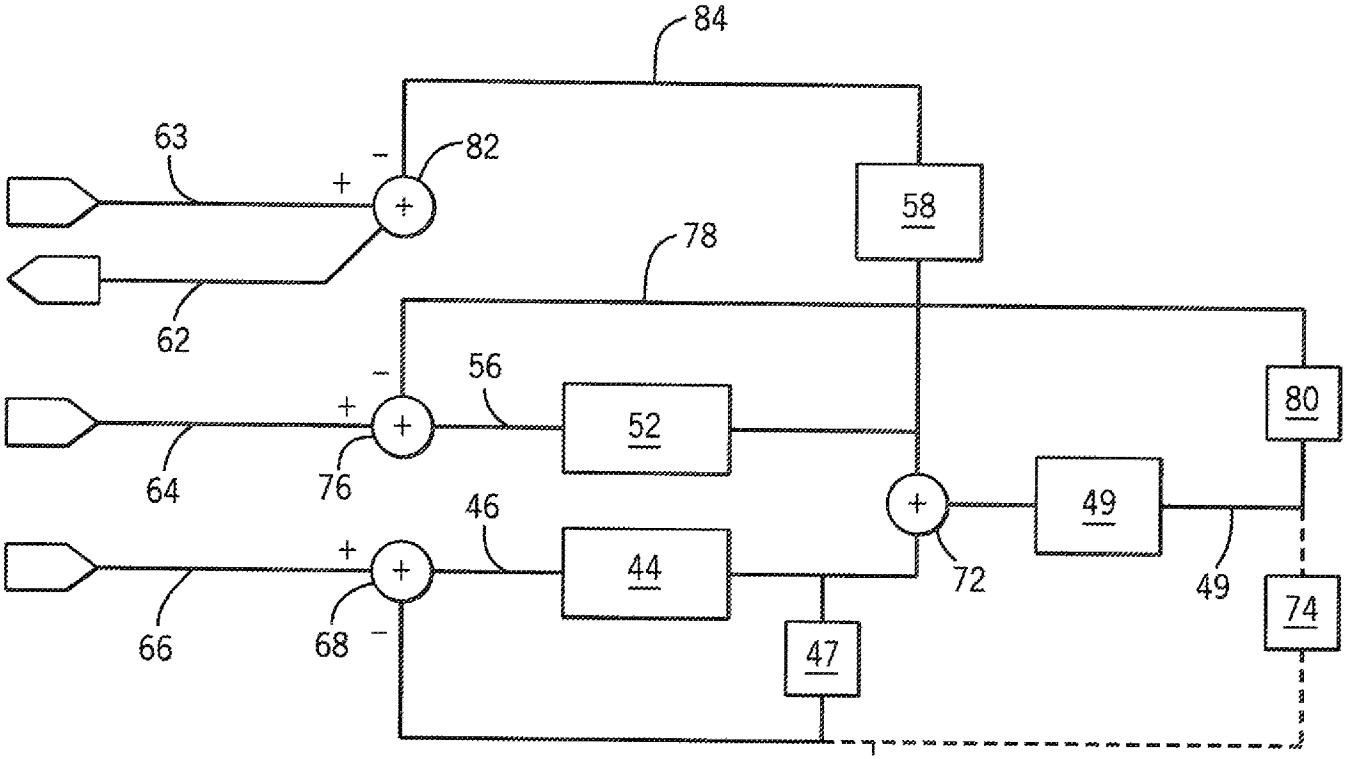
FIG. 4 is a block diagram of a feedback circuit implemented a controller being a component of the embodiment of FIG. 1.

Referring now to FIG. 4, the controller 48 executing the program may implement two independent feedback loops for electrically controlling the voice coil 44 and the linear actuator 52, for example, to independently control the bias motion 32 and vibration motion 30 discussed above with respect to FIG. 2. Different parameters of bias motion 32 and vibration motion 30 including force, excursion range, frequency, energy, and power may be controlled as will be discussed below. A minor feedback loop (not shown) may also be provided to control the position of the linear actuator 52 for machine initialization and the like.

Control of the voice coil 44 may be according to a vibration command signal 66, for example, indicating a desired vibration quality such as force, excursion, energy or the like. The vibration command signal 66 will be provided to a summing junction 68 (typically implemented in software within the controller 48) receiving a feedback signal 70 having the same dimensions (e.g. force, excursion, energy etc.) as the vibration command signal 66. The summing junction 68 subtracts the feedback signal 70 from the vibration command signal 66 to produce an "error signal" in the form of the vibration control signal 46 communicating with the voice coil 44.

The feedback signal 70 may be provided by the optical position sensor 47 to provide direct control of vibration motion (e.g. amplitudes, frequency etc.) as well as position derived quantity such as energy, force and the like.

Control of the linear actuator 52, may be according to a bias force command signal 64, indicating a desired bias force. The bias force command signal 64 will be provided to summing junction 76 (also typically implemented in software within the controller 48) receiving feedback signal 78. The feedback signal 78, also having units of force, is subtracted from the bias force command signal 64 to produce a stepper motor command signal 56 to the stepper motor 54 of the linear actuator 52. The feedback signal 78 may be derived from the load cell 51 to provide direct control of bias force as well as force derived quantities such as, energy transfer and the like. In a second embodiment, the load cell 44 may be used to develop both feedback signals 70 and 78. In this embodiment, the motion of the voice coil 44 is mechanically summed with motion of the linear actuator 52 (by virtue of their series connection) as depicted in FIG. 3. This mechanical summing is represented by summing junction 72 in FIG. 4 and provides a combined mechanical displacement to the load cell 49. The load cell may produce a load signal 51 that will generally contain a high-frequency vibration motion 30 superimposed on (providing excursions about) a low-frequency bias motion 32. The load signal 51 may be provided to a vibration extractor 74 (also typically implemented in software) that may process the load signal 51 to provide a variety of different parameters related to vibration including vibration excursion, peak vibration force, energy absorption and the like. Vibration excursion may, for example, be extracted by applying a high pass filter to the signal 51 and then measuring the amplitude of the result. This extracted amplitude can then provide feedback signal 70 of the vibration excursion. It will be understood that other parameters such as vibration force may be deduced from the known dynamic qualities of the load cell 49 and the associated structure of the actuator assembly 28 (masses and spring constants) and energy transfer may be deduced by comparing the load signal 51 to the vibration command signal 66. Generally, it will be appreciated that energy transfer may be controlled by monitoring a variety of parameters including but that are not limited to peak-to-peak vibration displacement, vibration frequency, vibration acceleration, alternating vibratory force, vibration wave form, joint flexion angle, direction of applied vibration, direction of applied bias force, bias force magnitude, treatment duration, compliance of user and system as well as combination of user in system, etc.

The output of the vibration extractor 74 in any of these cases provides the feedback signal 70. It will be understood that a first feedback loop including vibration command signal 66, summing junction 68, voice coil 44, load cell 49, and vibration extractor 74 may control the vibration produced by the voice coil 44 to a precise input designated by vibration command signal 66. Generally the frequency of the vibration may be controlled "open loop" by providing a predetermined frequency of sine wave to the voice coil 44 or a predetermined electrical signal to a vibrating (rotary imbalance) motor or other motor used to drive vibration motion, but it will be appreciated that frequency may also be controlled "closed loop" using the above described feedback loop.

Control of the vibration uses sensors other than the load cell 49, for example, accelerometers, optical position sensors, linear variable differential transformers (LVDTs) or the like, to provide any of position, acceleration, force or velocity feedback for corresponding measurements of the corresponding dimensions of the vibration command signal 66 which may be characterized in any of these ways.

Figure 5:
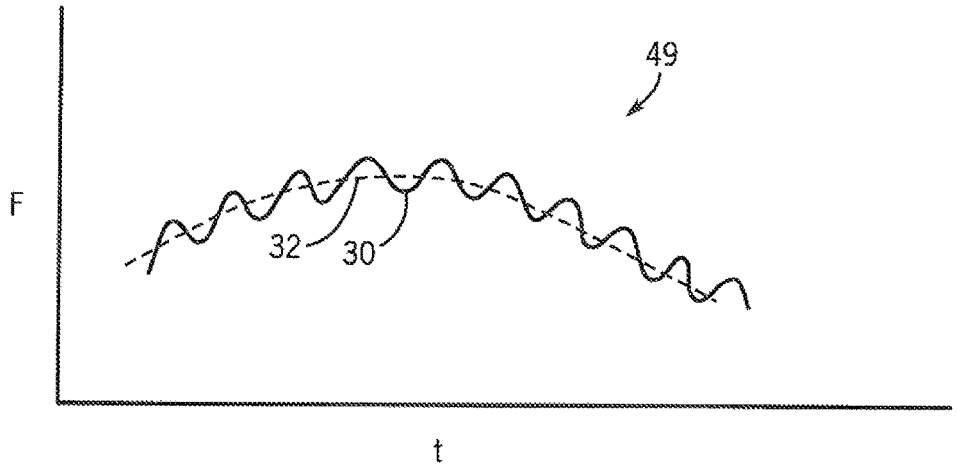
FIG. 5 is a diagram of a signal provided by the load cell as may be separated into a bias in vibratory feedback signals by signal processing.

Referring still to FIGS. 4 and 5, the load signal 51 may also be provided to a bias force extractor 80 which extracts only the bias motion 32 from the load signal 51. This bias force extractor 80 may also be implemented in software, for example, as a low pass filter or window averaging circuit or the like. This extracted bias force provides feedback signal 78.

Thus it will be understood, therefore, that a second feedback loop including bias force command signal 64, summing junction 76, linear actuator 52, load cell 49 and bias force extractor 80 may control the force amplitude of the bias force produced by the linear actuator 52 to a precise input value designated by bias force command signal 64. The ability to provide feedback control of a particular bias motion 32 is important during the application of vibration when the user 11 may unconsciously increase force on the footplate in response to the simulation. This feedback control moves the vibration surface 26 back to offset this unconscious increased pressure by the user.

Referring still to FIG. 4, a position command signal 62 indicating a desired position of the vibration surface 26 may be received by a summing junction 82 (typically implemented in software within the controller 48) also receiving a feedback signal 84 (either developed internally by monitoring the stepper motor command signal 56, or obtained as absolute position signal 60 from the encoder 58 or from a linear encoder located to monitor relative position between floor structure 23 and footplate 26) and subtracting it from the position command signal 62 to produce the position error signal 63. In one example (not depicted), the error signal 63 may be provided to the linear actuator 52 instead of the signal from summing junction 76 to permit closed loop control of the position of the linear actuator 52, for example, during initialization of the musculoskeletal stimulation device 10.

As shown, however, the position error signal 63 maybe output to provide an indication to the user 11 of a desired position of the vibration surface 26 so that a feedback loop is effectively implemented through the user 11 as will be described below.

Figure 7:
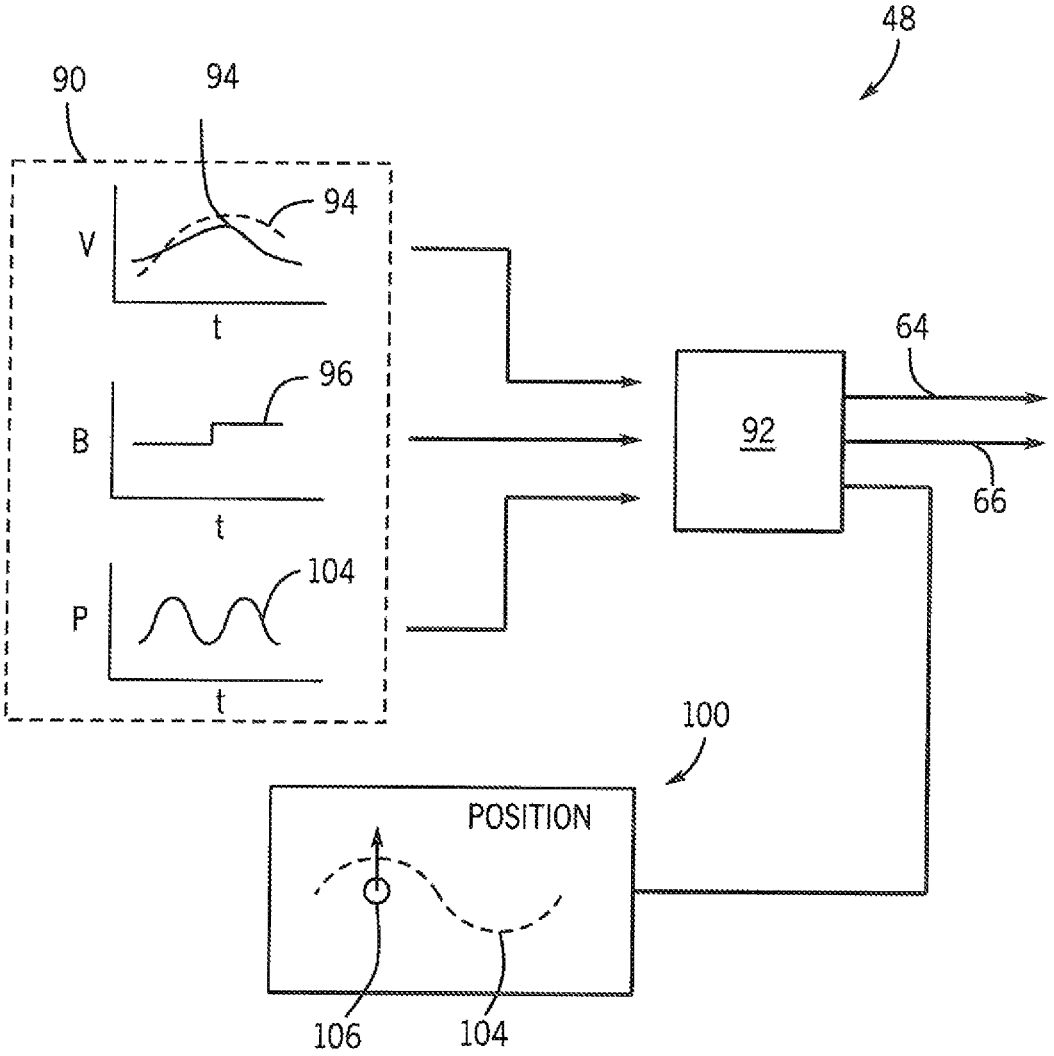
FIG. 7 is a control flow diagram showing control signal profiles that may be used to implement different exercise regimes using the system of the present invention.

Referring now to FIG. 7, the ability to accurately control both vibration and bias force on the vibration surface 26 allows the present invention to implement a number of training sequences that may be executed by the controller 48, for example, from stored data structures 90 and executed by a profile execution program 92 held in memory.

In one example, a vibration profile 94 may describe a peak vibration force that varies over time and a bias force profile 96 may describe a bias force that varies over time. Typically the bias force profile 96 will adopt values between about 10 pounds to at least 80 pounds of force. The vibration profile 94 and bias force profile 96 can control the musculoskeletal stimulation device 10 to allow the user 11 to experiences vibration at a range of different bias forces. This control is affected by providing changing signals 66 and 64 according to the vibration profile 94 and bias force profile 96.

In addition to controlling a vibration force, vibration frequency may be controlled in a second dimension providing a vibration frequency profile 94'. In one nonlimiting example, vibration frequency may change from 13 hertz to rise to 34 hertz and then to drop again to 13 hertz over a period of about 10 seconds.

As noted, an analysis of the driving signal for the voice coil 44 versus the feedback signal 70 can reveal information about loading and energy transfer from the vibration surface 26 to the user 11 and other load/energy/power parameters including amplitude, averages, and the like. An analysis of the feedback signal 70 while sweeping through frequencies with the vibration profile 94 can provide information about a resonance of the combined user 11/musculoskeletal stimulation device 10 that may help identify the frequency of greatest muscle activation.

Similarly, a bias force profile 96 may be applied to change the bias force during the session spanned by the vibration profile 94 and vibration frequency profile 94'. In a passive mode implemented by the placement of the bolsters 36 against the knees of the user 11 (shown in FIGS. 1 and 2), this bias force profile 96 is simply applied to the feedback loops of FIG. 4 as input vibration command signal 66. In an active mode with the bolsters removed, the user 11 must control his or her legs to apply the necessary force based on information provided to the user from the musculoskeletal stimulation device 10.

For example, user 11 can monitor a display on a user interface 100 communicating with the controller 48 (shown generally in FIGS. 1 and 4). The display, for example, may provide a compliance zone and a marker moving with respect to that compliance zone that can be manipulated into the compliance zone by the user by changing the force of his or her legs against the vibration surface 26. Generally movement of the vibration surface 26 under the feedback control described with respect to FIG. 4, controlling bias force will greatly simplify this task of maintaining a desired force by the user 11 and the display to the user may simply show the relative position of the linear actuator 52 within its compliance or operating range so that the user 11 may center linear actuator 52 within that range. While the linear actuator 52 is operating within its compliance range, it will provide the necessary force control. The feedback loop for bias force may be slowed, for example, to respond (be updated) only at intervals of three seconds and with limited excursion during each update, to assist users 11 having reduced reaction speed. Alternatively, or in addition, movement of the vibration surface 26, under the guidance of the force feedback loop, may be limited in speed so that when the user pushes against the vibration surface 26, at a force slightly exceeding the prescribed force of the feedback loop, the vibration surface 26 recedes at a constant rate allowing the user 11 to implement a leg press exercise. Generally, guidance to the user 11 with respect to the necessary force to be applied to the vibrations surface 26 by the user 11, is provided in the form of the vibration surface 26 moving toward the user 11 (when the user's force is below that required) and away from the user 11 (when the user 11 applies excess force to the vibration surface 26). The device will automatically stop treatment (movement and vibration) if an overload force is detected in excess of a predetermined amount or percentage of the prescribed setpoint of the feedback control or if the vibration surface 26 reaches an extreme of travel, for example as detected by limit switches 51 shown in FIG. 3.

As noted generally above, the vibration of the vibration surface 26 may stop if the desired force level is not being maintained by the user 11 (i.e., the user 1 is not pressing hard enough against the vibration surface 26). This can prevent unwanted noise when a user is backing their legs off (i.e. reducing force on the vibration surface 26) during a leg press. The presence or absence of, or adjustment, of vibration can also indicate to a user 11 (as a user-implemented feedback loop) that they should increase the force applied to the vibration surface 26 while retracting their legs in order to maintain a prescribed level of bias force (slightly above the target load during pushing and slightly below the target load during retraction).

In an alternative embodiment, in the active mode, the vibration of vibration surface 26 may be controlled to switch off when a desired bias force is not obtained as a result of improper muscular resistance by the user 11. In this mode, the user 11 is instructed to press on the vibration surface 26 with increasing force until vibration begins and then to moderate the pressure on the vibration surface 26 to sustain vibration.

In another example, a position profile 104 may be provided together with profiles 94 and 96 and the user 11 instructed to use his or her legs to try to move the vibration surface 26 while it is vibrating, and against the bias force of the profile, to follow the desired position profile 104. This may be accomplished again by a display on user interface 100 showing a trajectory of the position profile 104 and the current position 106. The user 11 may manipulate the current position 106, increasing or decreasing force on the vibration surface 26 to move the vibration surface 26 responding under feedback control to maintain a given force. In this way a dynamic exercising of the user's muscles under vibration with a predetermined load may be provided. A position profile 104 may be implemented with a bias force profile 96 only and without a vibration profile (that is, with zero vibration) so that the present invention may provide dynamically loaded motion without vibration.

Generally the profiles of 94, 96 and 104 may include periods of rest and or repetitions. The profiles 94, 96, and 104 may be entered or modified by operator input commands from the user 11 or others. Such operator input commands may define or modify, for example, the shape of standard curves or may provide arbitrary profile curves through the entry of multiple data points. These operator input commands may be may be entered through the interface 100 or another computer connected to the controller 48 according to techniques well known in the art.

Figure 6:
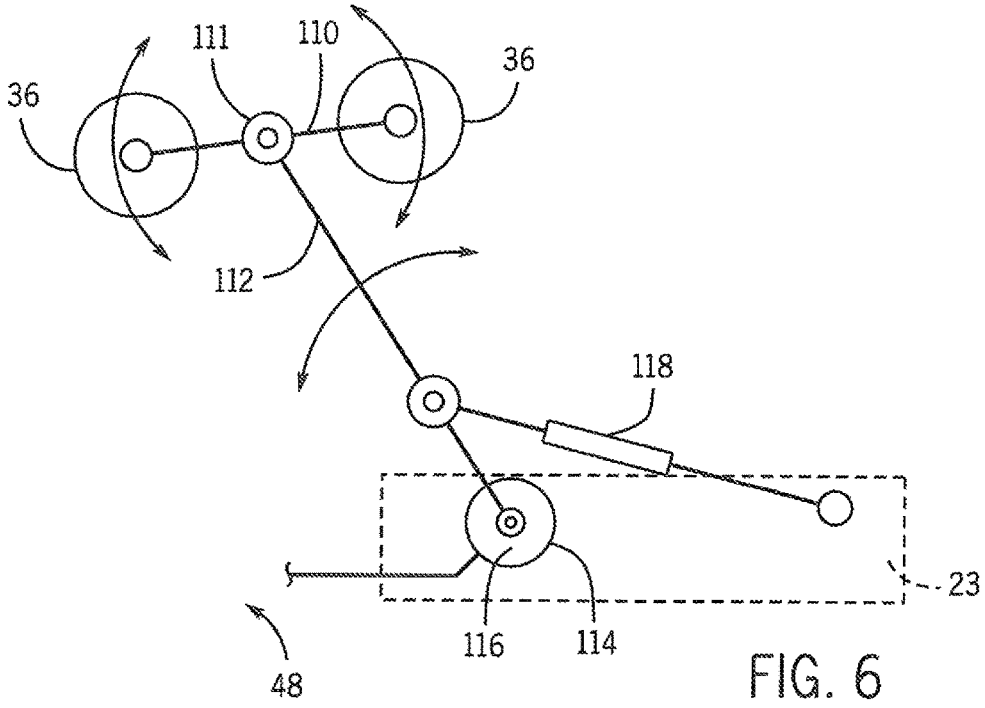
FIG. 6 is a kinematic diagram of the knee brace of FIG. 1 showing its control and positioning.

Referring now to FIGS. 1, 2, and 6, the bolsters 36 may be generally padded cylinders extending across actuation axis 34 to fit on either side of the knees as separated by an equalizer arm 110. The equalizer arm 110 extending between the bolsters 36 may pivot at a pivot 111 midway along the equalizer arm 110 and join the equalizer arm 110 to one end of a swing arm 112. The swing arm 112 may communicate to its opposite end with the floor support 23 through a second pivot 114. In this way, the bolsters 36 may be moved down against the knees of the user 11 by downward rotation of the swing arm 112 with rotation of the bolsters 36 about the pivot 111 equalizing force above and below the knees of the user 11. Alternatively, the swing arm 112 may be moved upward to move the bolsters 36 away from the knees of the user 11 to allow the user 11 to freely exit the musculoskeletal stimulation device 10.

Pivot 114 is attached to an electronic clutch 116 so that it may be locked in a position to restrain upward motion of the knees of the user 1 for operation of the musculoskeletal stimulation device 10 in a passive mode. In this case the bolsters 36 resist upward force of the knees of the user 11. The clutch 116 may communicate with the controller 48 according to a desired mode of operation as may be programmed in the controller 48.

A gas spring 118 may communicate between the floor support 23 and the swing arm 112 to provide a viscously damped upward bias to the swing arm 112 when the clutch 116 is released.

An emergency stop button 101 (shown in FIG. 1) may communicate with the controller 48 to receive operator input commands to terminate a session controlled by a profile, stopping movement of the linear actuator 52 and vibration of the voice coil 44 and releasing the clutch 116. Footplate 26 may also communicate with controller 48 to return to a default position when the emergency stop button 101 is depressed.

The performance of the user 11 during execution of a profile 94, 96, or 104 may also be recorded, for example, by logging the feedback signals 70, 78 and 84 or the error signals. The log data may be displayed to a user 11 in real time or after the profile to assess performance improvement by the user 11. It will be appreciated that this data may be displayed locally, printed, transmitted wirelessly, or transmitted by digital storage media for use by others.

Feedback loops may also be used to drive other devices used in conjunction with the treatment device referenced herein. For example, neuromuscular electrical stimulation devices attached to the user 11 may compliment treatment by emitting a voltage that is synchronous, phase shifted, or otherwise related to the applied vibration or bias force signal. Ultrasound and diathermy devices (not shown) may be applied in the same manner, as could be other complimentary therapeutic modalities.

The inventors contemplate that the present invention is not limited to use on the legs but may find use as an analogous system for exercising the arms or other portions of the body.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to "a controller" can be understood to include one or more microprocessors that can communicate in a stand-alone and/or a distributed environment(s), and can thus be configured to communicate via wired or wireless communications with other processors, where such one or more processor can be configured to operate on one or more processor-controlled devices that can be similar or different devices. Furthermore, references to memory, unless otherwise specified, can include one or more processor-readable and accessible memory elements and/or components that can be internal to the processor-controlled device, external to the processor-controlled device, and can be accessed via a wired or wireless network.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. An apparatus for applying an axial vibratory force and an axial bias force to a limb of a user of the apparatus, the limb having at least first and second segments each having axes and communicating by a joint, the apparatus comprising:

a base an operator surface adapted to communicate with a distal portion of the limb to communicate forces thereto and wherein the operator surface is movably mounted with respect to the base to accommodate dynamic motion of the limb while communicating the forces thereto;

an actuator assembly that defines an actuation axis and moves the operator surface to impart a bias motion and a vibration motion to the operator surface along the actuation axis;

a bias system communicating with the actuator assembly to receive a first electrical control signal to impart the bias motion to the operator surface for controlling a bias force applied to the limb through the operator surface;

a vibration system communicating with the actuator assembly to receive a second electrical control signal to impart the vibration motion to the operator surface for controlling a vibration force applied to the limb through the operator surface; and a control circuit providing the first and second electrical control signals to the bias system and vibration system to maintain a predetermined bias force applied to the limb during dynamic motion of the limb and maintain the vibration motion independent of the predetermined bias force applied to the limb.

2. The apparatus of claim 1 wherein the first and second electrical control signals are independent of each other with the first electrical control signal providing movement of the operator surface having a power spectrum concentrated at less than one hertz and the second electrical control signal providing a movement of the operator surface having a power spectrum concentrated at greater than 10 hertz.

3. The apparatus of claim 2 wherein the bias system provides motion of the operator surface to a range of greater than one inch and the vibration system provides motion of the operator surface constrained to a range of less than one inch.

4. The apparatus of claim 1 wherein the first electrical control signal provides an indication of desired force between the operator surface and the limb and wherein the bias system provides feedback control of the force between the operator surface and the limb by receiving the first electrical control signal and adjusting motion of the operator surface according to a difference between the first electrical control signal and a signal indicating a force between the operator surface and the limb.

5. The apparatus of claim 1 further including a third electrical signal providing an indication of the desired position of the operator surface and wherein the control circuit receives the third electrical signal and outputs an indication of a difference between the third electrical signal and a signal indicating a position of the operator surface.

6. The apparatus of claim 1 wherein the vibration system provides feedback control of a vibration of the operator surface receiving the second electrical control signal and adjusting vibration of the operator surface according to a difference between the second electrical control signal and a signal related to movement of the operator surface.

7. The apparatus of claim 1 further including a sensor providing a signal related to movement of the operator surface providing one of position, velocity, acceleration, and force of the operator surface.

8. The apparatus of claim 1 wherein the bias system and the vibration system provide independent feedback control using a common sensor for measuring a state of the operator surface.

9. The apparatus of claim 1 wherein the control circuit provides stored data describing a schedule of the first and second electrical control signals over time to regenerate the first and second electrical control signals.

10. The apparatus of claim 1 wherein the control circuit provides an output adapted to be received by a user of the apparatus providing an indication that a desired force is being applied by the user to the operator surface.

11. The apparatus of claim 10 wherein the output is an existence of vibration of the operator surface.

12. The apparatus of claim 10 wherein the output is a display providing a visual guidance as to an application of the desired force.

13. The apparatus of claim 1 wherein the control circuit provides an output to the user of the apparatus providing an indication of a desired position of the operator surface as moved by extension or retraction of the user's limb.

14. The apparatus of claim 1 further including a seat for receiving a user positioned so that the user's feet may rest upon the operator surface with a lower portion of the user's legs substantially normal to the operator surface when the user is seated on the seat.

15. The apparatus of claim 1 further including a user joint support constraining motion of the user's limb against force exerted on the user's limb by the operator surface.

16. The apparatus of claim 15 wherein the user joint support is a knee support for limiting upward motion of the user's knees when seated in the seat.

17. The apparatus of claim 16 wherein the user joint support provides at least one padded bolster held on a swing arm pivoting downward to apply the padded bolster against an upper surface of the user's knees when the user is seated in the seat with the user's feet supported by the operator surface and to limit upward motion of the user's knees.

* * * * *